US010784099B2

(12) United States Patent
Yasuda

(10) Patent No.: US 10,784,099 B2
(45) Date of Patent: Sep. 22, 2020

(54) INCANDESCENT LIGHT BULB

(71) Applicant: STANLEY ELECTRIC CO., LTD., Tokyo (JP)

(72) Inventor: Satoshi Yasuda, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 28 days.

(21) Appl. No.: 16/413,801

(22) Filed: May 16, 2019

(65) Prior Publication Data

US 2019/0355569 A1 Nov. 21, 2019

(30) Foreign Application Priority Data

May 17, 2018 (JP) ..... 2018-095501

(51) Int. Cl.

| | |
|---|---|
| ***H01K 1/40*** | (2006.01) |
| ***H01K 1/16*** | (2006.01) |
| ***H01K 1/38*** | (2006.01) |

(52) U.S. Cl.

CPC ..... *H01K 1/40* (2013.01); *H01K 1/16* (2013.01); *H01K 1/38* (2013.01)

(58) Field of Classification Search

CPC ..... H01K 1/38; H01K 1/16; H01K 1/40

See application file for complete search history.

(56) References Cited

U.S. PATENT DOCUMENTS

| | | | | |
|---|---|---|---|---|
| 3,265,923 A | | 8/1966 | Preziosi et al. | |
| 4,479,072 A | | 10/1984 | Gaugel et al. | |
| 5,061,873 A | * | 10/1991 | Belliveau | H01K 1/18 313/269 |

FOREIGN PATENT DOCUMENTS

| | | | | |
|---|---|---|---|---|
| CA | 2527300 A1 | * | 7/2006 | H01J 5/46 |
| GB | 1 538 839 A | | 1/1979 | |
| JP | H06-77149 U | | 10/1994 | |

OTHER PUBLICATIONS

Partial European Search Report for the related European Patent Application No. 19174775.7 dated Oct. 16, 2019.

* cited by examiner

*Primary Examiner* — Joseph L Williams
*Assistant Examiner* — Jacob R Stern
(74) *Attorney, Agent, or Firm* — Kenealy Vaidya LLP

(57) ABSTRACT

To aim at a prevention of an occurrence of failure in and an extension of the life span of an incandescent light bulb by reducing the impact of an external force, which is applied to an outer lead wire positioned outside a bulb, on the connections between the lead wire and another element when manufacturing the incandescent light bulb, especially in a socket mounting process. In an incandescent light bulb wherein a filament assembly having filaments and lead wires which support the filaments is sealed in a bulb, a shape which, being easy to bend, enables a reduction in the impact of an applied external force on another element is imparted to a region of a predetermined length which includes the boundary of the lead wires between inside and outside the bulb. For example, a region in which the cross-sectional shape of the lead wires is changed by crushing is provided.

11 Claims, 7 Drawing Sheets

2
22a
22b
23
21
21D
21
21S 25
21a
21b
FRONT VIEW
23
21
21
SIDE VIEW 25
21
21
23'

1
2
3

1
2
3
BURNER
BURNER 15
15
PINCHER MOLD
PINCHER MOLD
SIDE VIEW
FRONT VIEW
TO FIG. 7A 15
21b

3
EXHAUST HEAD

BURNER
BURNER
EXHAUST HEAD

10

10
5

INCANDESCENT LIGHT BULB

BACKGROUND OF THE INVENTION

1. Technical Field

The present invention relates to an incandescent light bulb used as a light source, such as a lamp fitting or a lighting device, and particularly to an improvement of the structure of supporting a filament.

2. Related Art

An incandescent light bulb, which emits light with a simple power source regardless of AC or DC, is superior in color rendering properties, and is widely used in various fields even in the present day when there prevail other light sources, such as a fluorescent lamp and an LED, which have superior characteristics such as low power consumption.

An incandescent light bulb, as well known, has a structure wherein a filament assembly formed of a filament, which is a light emitting source, and lead wires, which are connected to each end of the filament, is sealed in a glass bulb with end portions of the lead wires remaining outside, and wherein a ferrule or a socket is connected to the end portions of the lead wires (outer lead wires) outside the glass bulb. The filament assembly is commonly fabricated such that the lead wires are fixed by a glass support member or stem called a bridge, thus preventing a problem in the process of manufacturing the incandescent light bulb, at the time of shipment, at the point of use, or in the like case, that a force is applied to the filament via the outer lead wires, and the connections between the lead wires and the filament come off, or a disconnection therebetween occurs.

However, the fixation becomes unstable due to a difference in thermal expansion coefficient between glass which is a material configuring the bridge and a metal which is the material of the lead wires, as a result of which, an extra force is applied to the filament, and there is, for example, a possibility that the filament is deformed, or the connections between the filament and the lead wires come off. For this reason, in the heretofore known incandescent light bulb, portions of the lead wires surrounded by the glass of the bridge are crushed, or the surfaces of the portions are roughened, thus increasing the degree of adhesion with the glass. It is also proposed that the portions of the lead wires fixed in the bridge be bent at a predetermined angle, thereby preventing the lead wires or support wires, which support the filament, from turning around (PTL 1).

[PTL 1] JP-UM-A-6-77149

In the process of manufacturing an incandescent light bulb, as shown in FIGS. 1A to 1E, after a filament assembly 20, together with an exhaust tube 3, is inserted into a glass cylinder 1, one end of which is hemispherical and closed and the other end of which is open (A), the open end portion of the cylinder, with partial portions of outer lead wires 21*b* remaining out of the bulb, is melted and closed into a sealing portion 15 (B), and after the air in the bulb is exhausted, or is replaced with a filler gas, such as an inert gas, through the exhaust tube 3, an end portion of the exhaust tube 3 is sealed, bringing the inside of the bulb into a hermetically sealed state (C). In this state, the outer lead wires 21*b* outside the bulb 1 extend as extensions of inside lead wires (inner lead wires) 21*a*, but are, for example, bent (D) in order to fix a socket 5 around the bulb end portion (sealing portion) 15 (E). For example, the outer lead wires are bent at the bulb end portion and again bent at the outer peripheral edge portion of the bulb end portion 15 into a U-bend shape.

At this time, an external bending force applied to the outer lead wires 21*b* is also applied to the glass sealing portion 15, and there is a case in which the sealing portion cracks or an edge portion thereof breaks. In an incandescent light bulb wherein the outer lead wires 21*b* are doubled in order to increase the area of contact with the socket, a larger force is required to bend the lead wires, and so a force acting on the sealing portion 15 is also still larger. When the sealing portion 15 is broken due to this, it causes a destruction of the hermetically sealed state of the incandescent light bulb or a poor electrical contact between the lead wires and the socket, incurring a defective lighting or a decrease in the life span of the incandescent light bulb. Also, the lead wires of the filament assembly are fixed by the glass bridge 23, but a force acting when bending the outside lead wires also affects the portions fixed by the bridge 23 or the portions of connection between the filament 22 and the lead wires 21, also leading to a break of the filament assembly 20.

SUMMARY OF THE INVENTION

The invention, having been contrived in order to solve the heretofore mentioned problems, has for its object to promote a prevention of an occurrence of failure in and an extension of the life span of an incandescent light bulb by reducing the impact of an external force, which is applied to outer lead wires positioned outside a bulb, on the connections between the lead wires and another element when manufacturing the incandescent light bulb, especially in a socket mounting process.

In order to solve the heretofore mentioned problem, the invention is such that a shape capable of increasing the durability against bending stress (that is, which, being easy to bend, enables a reduction in the impact of an applied external force on another element) is created in a region of a predetermined length which includes the boundary of the lead wires between inside and outside the bulb of the incandescent light bulb. That is, according to the invention, the following incandescent light bulb is provided.

An incandescent light bulb includes a filament assembly including filaments and a plurality of lead wires connected to the filaments; and a bulb which, having at an end portion thereof a sealing portion in which are fixed the plurality of lead wires, seals therein the filaments of and partial portions of the plurality of lead wires of the filament assembly. The lead wires have a bent structure outside the sealing portion and have a shape-changed region, from inside to outside the sealing portion, in which the lead wires are changed in shape to be flat in cross section.

BRIEF DESCRIPTION OF THE DRAWINGS

FIGS. 2A and 2B are diagrams showing a structure of a incandescent light bulb of an embodiment, wherein FIG. 2A is a front view and FIG. 2B is a side view.

DETAILED DESCRIPTION OF THE EMBODIMENTS

Figures 1A, 1B, 1C, 1D, 1E:
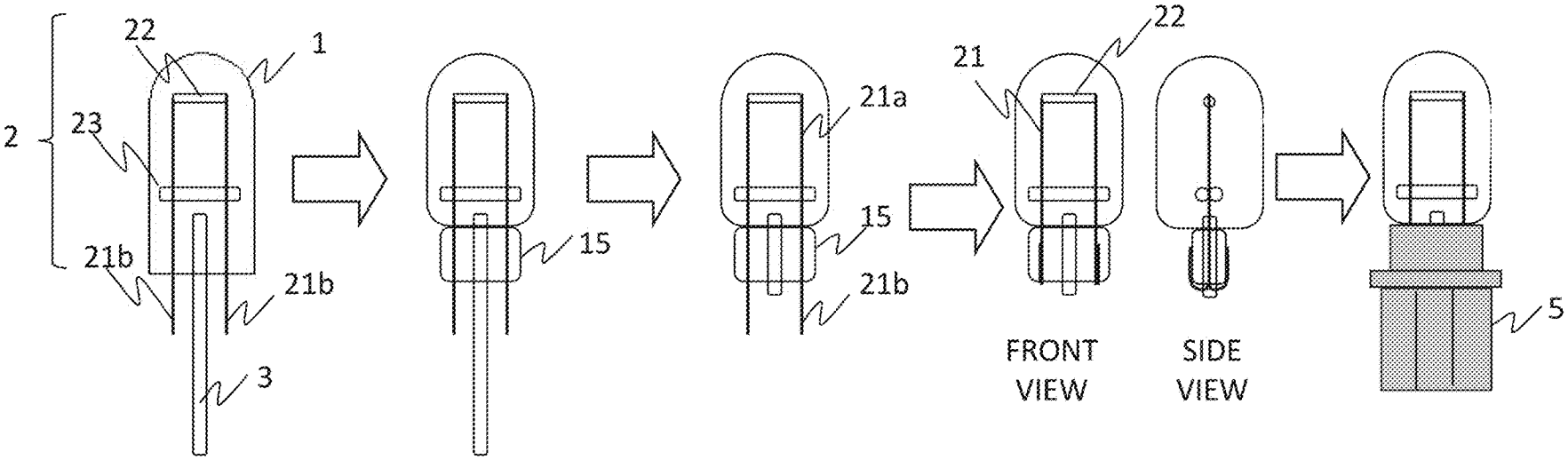
FIGS. 1A to 1E are diagrams illustrating a method of manufacturing an incandescent light bulb.

Hereafter, a description will be given, referring to the drawings, of one embodiment of an incandescent light bulb of the invention. Herein, a description will be given, as an example, of a wedge base type (plug-in type) incandescent light bulb, but the invention can be applied, not only to the wedge base type, but to any incandescent light bulb of a structure wherein a filament assembly having filaments and lead wires is sealed in a bulb.

Figure 2B:
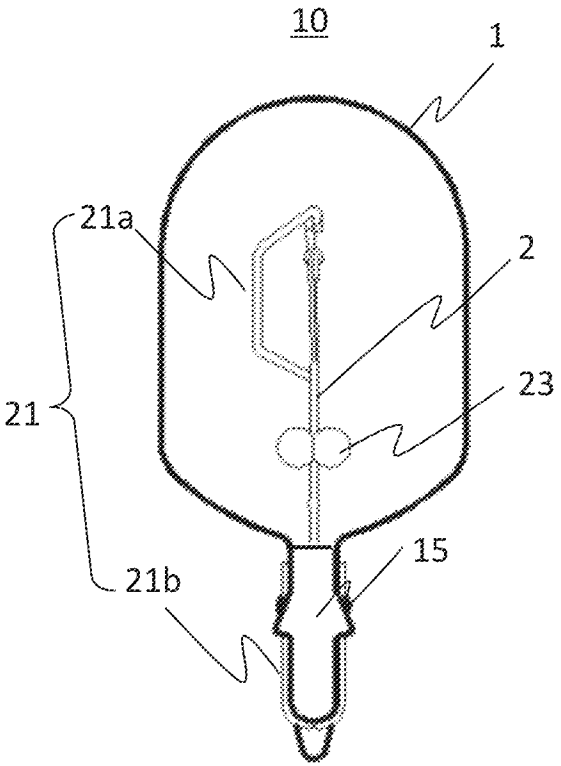
Figure 2A:
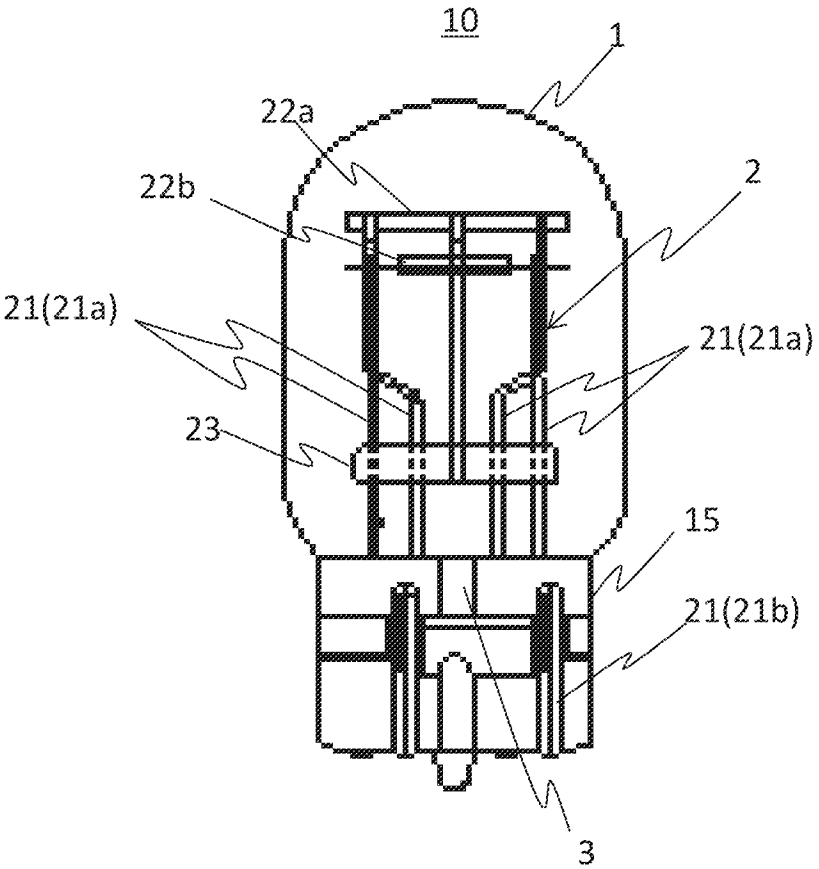

An incandescent light bulb 10 shown in FIGS. 2A and 2B, being a wedge base type (plug-in type) incandescent light bulb including two filaments, includes a bulb 1 and a filament assembly 2 stored hermetically in the bulb 1.

The bulb 1, being made of a material, such as soft glass, which has heat resistance and is relatively easy to process, includes an end portion (a sealing portion) 15 having fixed therein the filament assembly 2. The bulb 1, of which there are various shapes, such as an elliptical shape, a spherical shape, a cylindrical shape, and a droplet shape, is not particularly limited in shape, but the wedge base type shown in FIGS. 2A and 2B often uses a cylindrical shape wherein an end portion of the cylinder is rounded. The inside of the bulb 1 can sometimes be vacuum, but commonly is sealed with a gas such as an inert gas. In the case of a halogen light bulb, a small amount of halogen gas, together with an inert gas, is sealed therein.

The filament assembly 2 includes two filaments 22*a*, 22*b*, into each of which a wire of tungsten or the like is coiled, and four lead wires 21, which support and are electrically connected to both ends of respective filament. The filaments 22*a*, 22*b* are such that they differ in emission color or intensity and in function or that one of the filaments functions as an aid to the other. In the following description, the two filaments, when not specifically distinguishing therebetween, are collectively referred to as filaments 22. Also, the light bulb shown in FIGS. 2A and 2B has a structure wherein the two filaments 22*a*, 22*b* are disposed one above the other, but the filaments are not only disposed one above the other but can be disposed in various ways. Also, the filaments 22 can also be disposed in various directions, such as a horizontal direction, a vertical direction, and an oblique direction.

The filament assembly 2 may further include a support member (a bridge or a stem) which fixes portions of the individual lead wires 21 close to the sealing portion 15 with their electrical insulation maintained. The example shown in FIGS. 2A and 2B has a structure wherein the lead wires 21 are fixed by a bridge 23 configured from glass. Also, a wire rod 25 which supports the filaments 22 on the bridge 23 may be provided separately from the lead wires.

The lead wires 21, being conductor wires with which to connect the filaments 22 and an external power source, are each formed mainly of an inner lead wire 21*a* which is inside the bulb and an outer lead wire 21*b* which is outside the bulb. The outer lead wire 21*b* is doubled over (into a doubled wire portion) with an end portion bent back in order to increase the area of contact with the terminal of a socket (not shown) to plug the incandescent light bulb therein, and is fixed in the sealing portion 15 of the bulb 1 so as to include one portion of the doubled wire portion.

The lead wires 21 and the wire rod 25 are configured from conductive materials, such as a molybdenum wire, a nickel wire, a Dumet wire, and a Dumet wire with a nickel plating film, and can also be configured from a single conductive material, but commonly, the inner and outer lead wires 21*a* and 21*b* are configured from different materials, and the inner lead wires 21*a* are also each divided into some portions, such as a portion which supports the filaments 22, a portion which is fixed by the bridge 23, and a portion which passes through the sealing portion 15 from inside to outside the bulb 1, selecting optimal materials for the respective portions. For example, a non-alloy material with a high melting point, for example, a material composed mainly of molybdenum, is used for the portion which supports the filaments 22, and a material close in thermal expansion coefficient to a material (for example, soft glass) configuring the bridge, for example, a material containing nickel, is used for the portion fixed by the bridge 23. Also, the portion passing through the sealing portion 15 and the outer lead wires can be configured from a Dumet wire or a Dumet wire with a nickel plating film. A joint portion between different materials is fixed by welding or the like.

The sealing portion 15 of the bulb 1 is a portion formed by being molded so as to bring the opening end portion of a cylindrical body configuring the bulb into a molten state and hermetically seal the inside of the bulb with pincher molds, and has a rectangular cross section shape wherein the side surfaces are narrower in width than the front surface. The lead wires 21 are passed through and fixed in the sealing portion 15. Also, the sealing portion 15 has included therein, as well as the lead wires 21, an exhaust tube 3 through which the air in the bulb 1 is exhausted and, as required, a filler gas is taken in, in the process of manufacturing the incandescent light bulb. The opening of outside end portion of the exhaust tube 3 is closed after manufacture, thereby securing the hermetic state inside the bulb 1.

Figure 3:
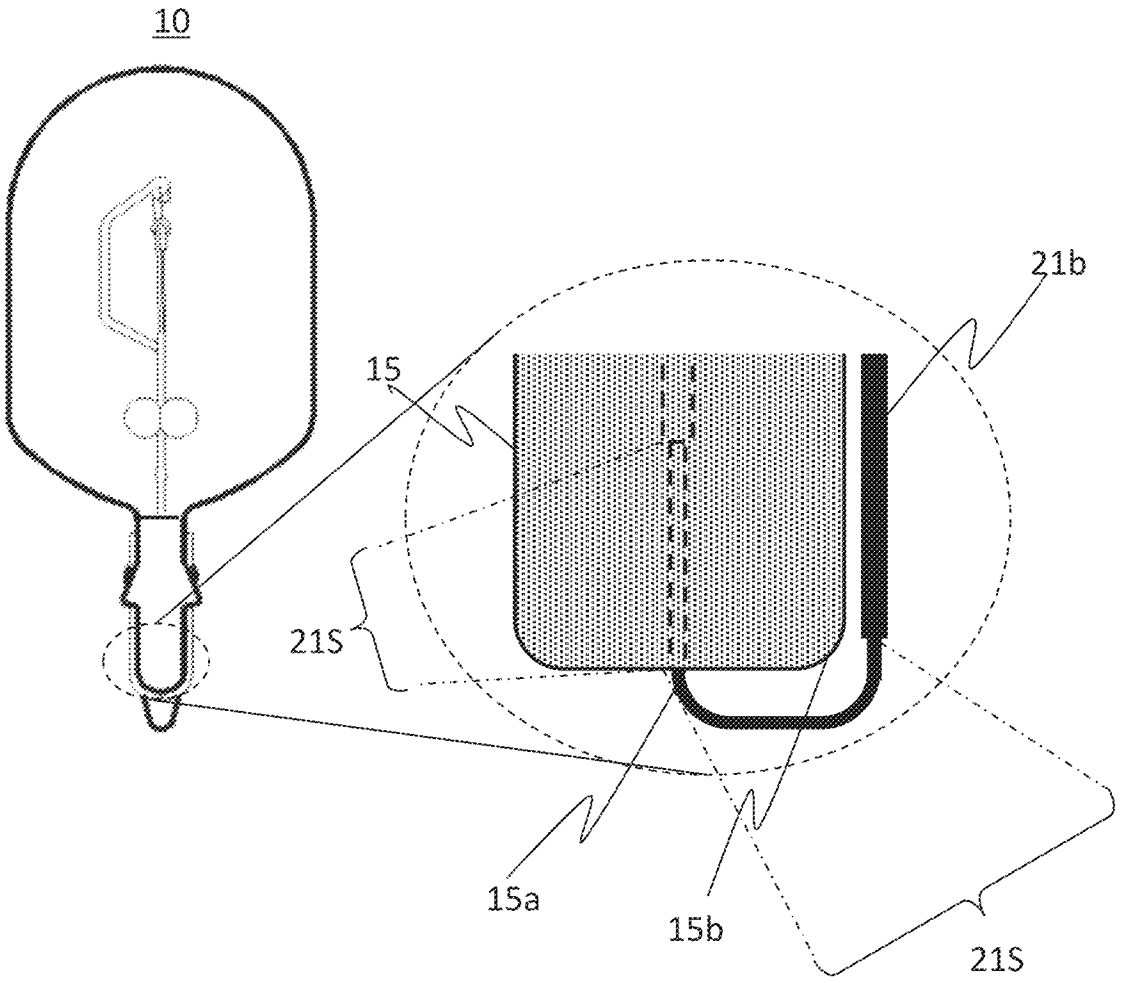
FIG. 3 is a diagram showing a major portion (side view) of the incandescent light bulb of FIGS. 1A to 1E.

The outer lead wires 21*b* each have a shape wherein the portion thereof (doubled wire portion) outside the sealing portion 15 is bent along the end portion of the sealing portion 15 and then bent back to the outer peripheral side of the sealing portion 15, as shown in FIG. 3. In FIG. 3, only one of the plurality of outer lead wires 21*b* is typically shown, and the other is omitted from illustration. Here, one portion of the outer lead wire 21*b* positioned in the sealing portion 15 and the bent portion continuous therewith of the outer lead wire 21*b* have a region (a shape-changed region 21S) changed in shape by crushing (flat crushing). The bent portion of the outer lead wire 21*b* is doubled to increase the area of contact with the socket terminal, and so has a low bending stress against an external force applied when bent (that is, has a high strength against bending), and the external bending force is likely to be applied to the bulb sealing portion 15 in contact with the lead wire, especially to edge portions 15*a* and 15*b* thereof. In contrast, when a portion (a portion including the bent portion) of the lead wire from inside to outside the sealing portion 15 is crushed in advance, it is possible to increase the bending stress of the lead wire 21 and to reduce the force applied to the sealing portion 15, and thus possible to prevent a break, a crack, or the like from occurring in the edge portions of the sealing portion 15.

The extent of crushing is not particularly limited, but in order for the lead wire to maintain a certain strength even after the crushing, the thickness of the portion changed in shape by flat crushing is preferably 90% or more, more preferably 95% to 98%, of the diameter of the intact lead wire (circular cross section). For example, the dimension of a 0.5 mm diameter lead wire crushed is preferably 0.45 mm or more in diameter, most preferably on the order of 0.48 mm in diameter. By adopting these kinds of ranges, it is possible to prevent a problem, such as a deformation of the lead wire, in the manufacturing process or the like, and to reduce the external force applied to the sealing portion 15 when bending the lead wire.

Figure 4:
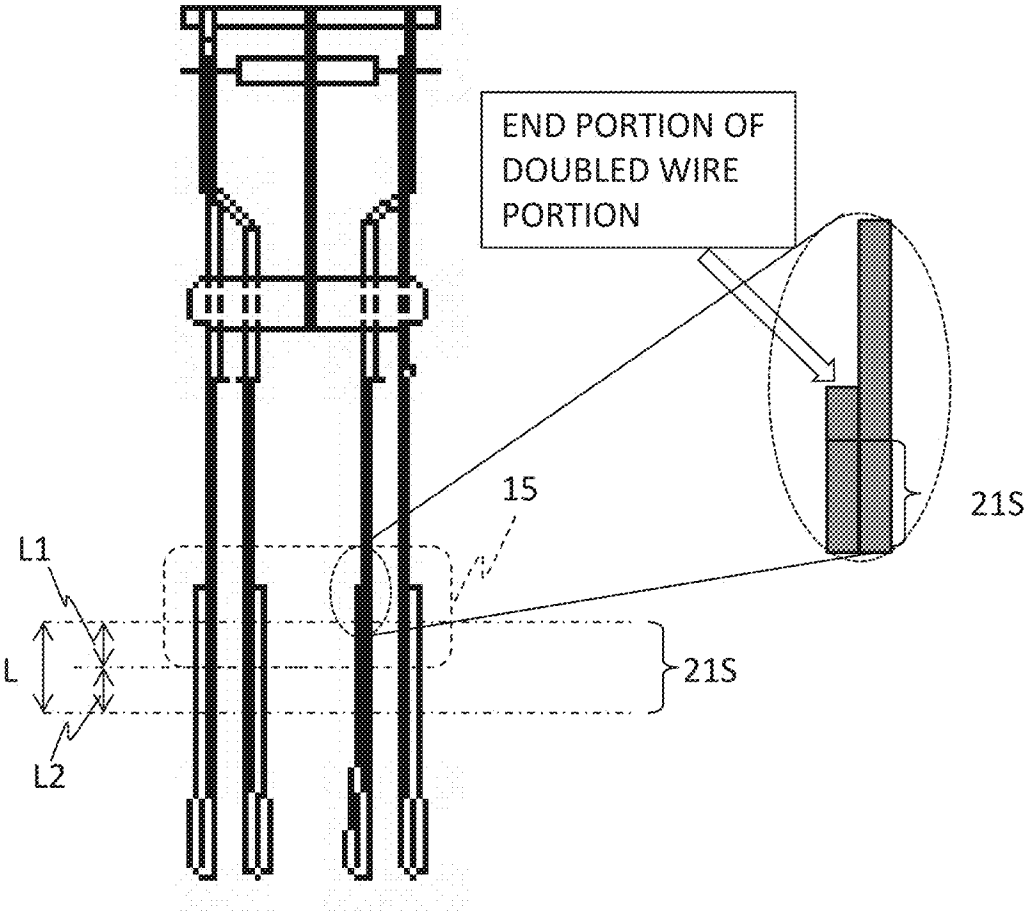
FIG. 4 is a diagram illustrating a shape-changed region.

Also, the length (L in FIG. 4) of the region 21S in which the lead wires are crushed is determined by considering the diameter of the lead wires, the distances (the distances in the radial direction of the lead wires) between the positions of the lead wires in the sealing portion 15 and the outer periphery of the sealing portion 15, and the like. Specifically, for example, the portions of the lead wires outside the sealing portion are preferably on the order of about 1.5 mm in length.

Regarding the lead wires inside the sealing portion 15, the larger the amount of the crushed portions (shape-changed region) are embedded in the glass of the sealing portion, the higher the strength of the sealing portion is. However, in the case of the end portion of the outer lead wire 21*b* being the doubled wire portion, when the lead wire is crushed up to the end portion (the position arrowed in FIG. 4) of the doubled wire portion, the shape of the leading end of the bent back lead wire is likely to split up or sharpen, and when sealed with glass, a crack is likely to occur in the glass with the leading end as the starting point. Consequently, the lead wires inside the sealing portion 15 are also such that a length L1 of the crushed region thereof is preferably on the order of about 1.5 mm. Consequently, in the case of the aforecited 0.5 mm diameter lead wires, the length of the shape-changed region thereof preferably measures about 1.5 mm inside the sealing portion 15, about 1.5 mm thereoutside, and on the order of 3 mm in total.

Next, a description will be given, referring to FIGS. 5A to 7E, of a method of manufacturing the incandescent light bulb of the embodiment.

Figures 5A, 5B, 5C:
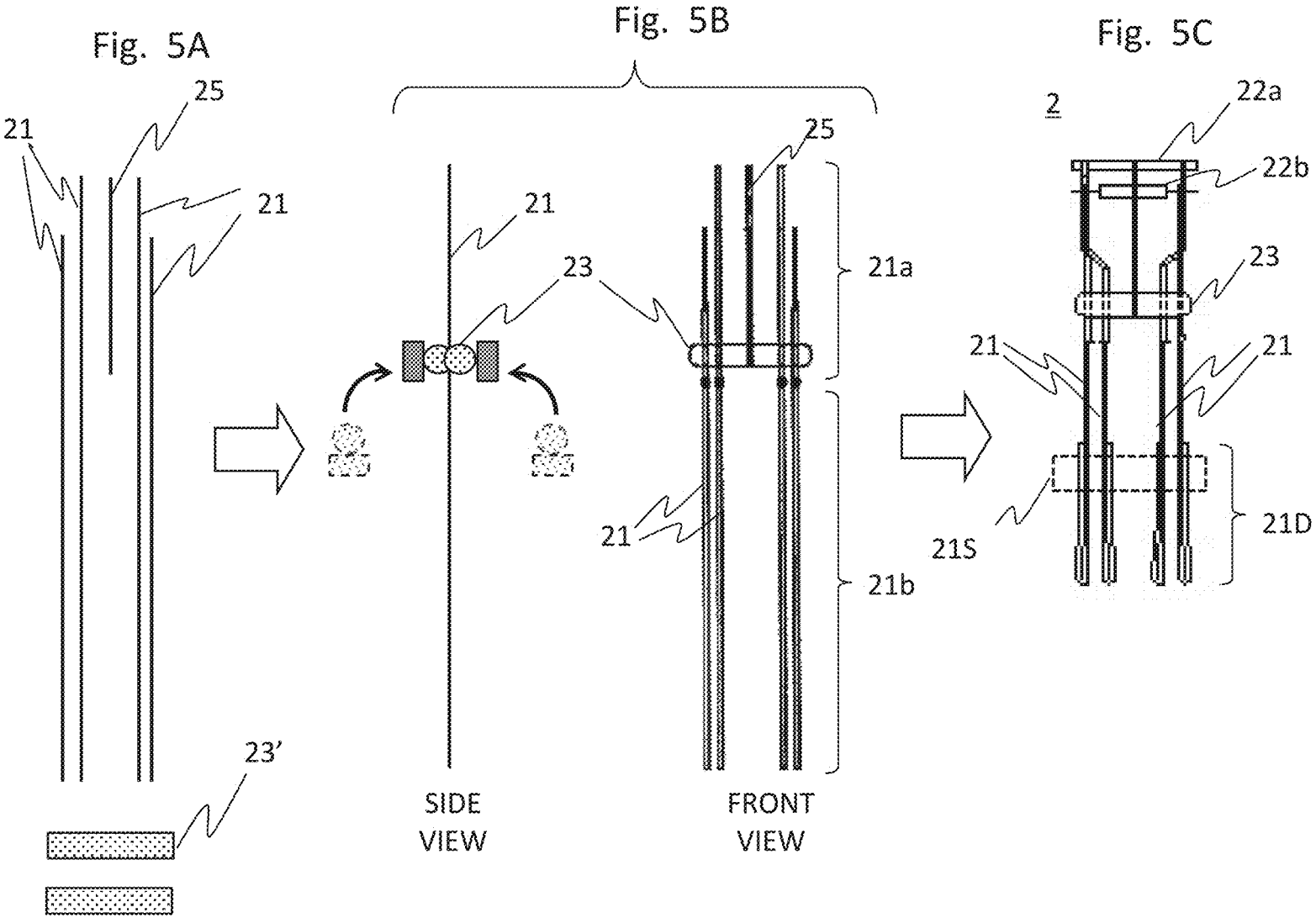
FIGS. 5A to 5C are diagrams illustrating a method of manufacturing a filament assembly.
Figures 6A, 6B, 6C:
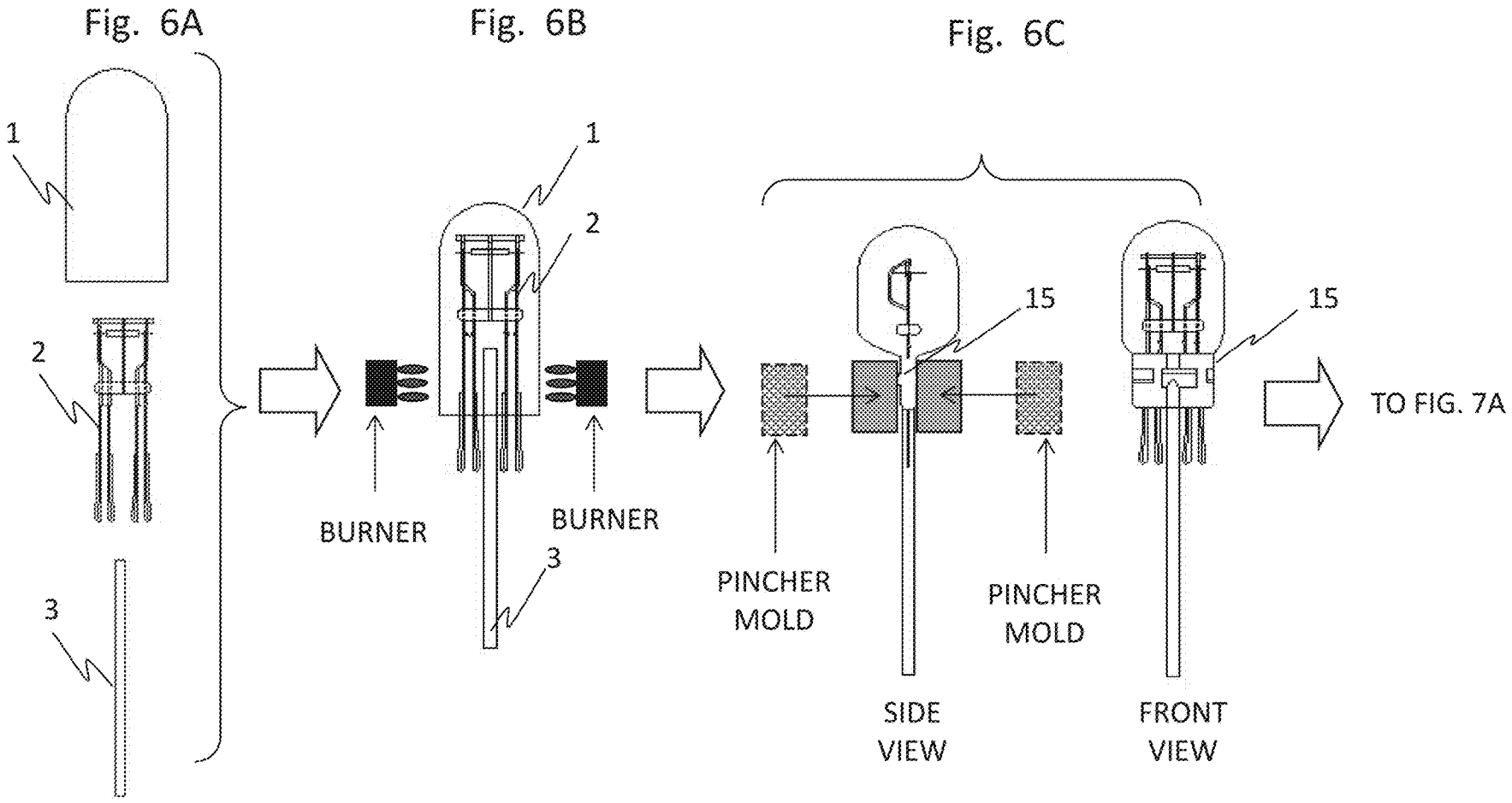
FIGS. 6A to 6C are diagrams illustrating a method of manufacturing the incandescent light bulb of the embodiment.

The components of the incandescent light bulb, that is, the bulb 1 cylinder with one end open, the filament assembly 2, and the exhaust tube 3, are prepared (FIG. 6A) . The filament assembly 2 is such that, as shown in FIGS. 5A and 5B, a total of four lead wires, a pair of lead wires for the filament 22*a* and a pair of lead wires for the filament 22*b*, and the wire rod 25 for supporting the filaments are disposed in their respective predetermined positions, and the lead wires 21 and the wire rod 25 are sandwiched between a pair of heated glass members 23' for the bridge 23 and then fixed in the bridge. Subsequently, the filaments 22*a*, 22*b* are fixed to their respective pairs of end portions of the lead wires 21 (FIG. 5C). The fixing method is not particularly limited, but is, for example, caulking. Also, the other end portions of the lead wires 21 are bent so as not to overlap with each other, and each of the end portions is shaped into a doubled wire portion 21D in advance. After that, the doubled wire portion 21D is crushed. A region (shape-changed region) 21S to be crushed is one portion of the doubled wire portion which does not include the leading end of the doubled wire portion 21D, as heretofore described, and when the sealing portion is formed after that, is a region ranging from inside the sealing portion to the bent portion of each of the outer lead wires 21*b*.

The filament assembly 2 fabricated in advance in this way and the separately prepared exhaust tube 3 are inserted from the opening of the bulb's glass cylinder and set in their respective predetermined positions in the bulb, as shown in FIG. 6B, and after that, the glass of the opening portion is heated from outside the opening by heating units, such as burners, into a molten state and pinched from outside by pincher molds, forming the glass sealing portion 15. The sealing portion 15 shaped by the pincher molds is a flat plate whose side surfaces are small in width, as shown in the side and front views of FIG. 6C, and four lead wires are disposed, alternately by two, along the surfaces large in width. The exhaust tube 3 is formed of a material equal in melting point to glass, such as soft glass, which configures the bulb, and kept hollow in the sealing portion 15 fusion process.

Figures 7A, 7B, 7C, 7D, 7E:
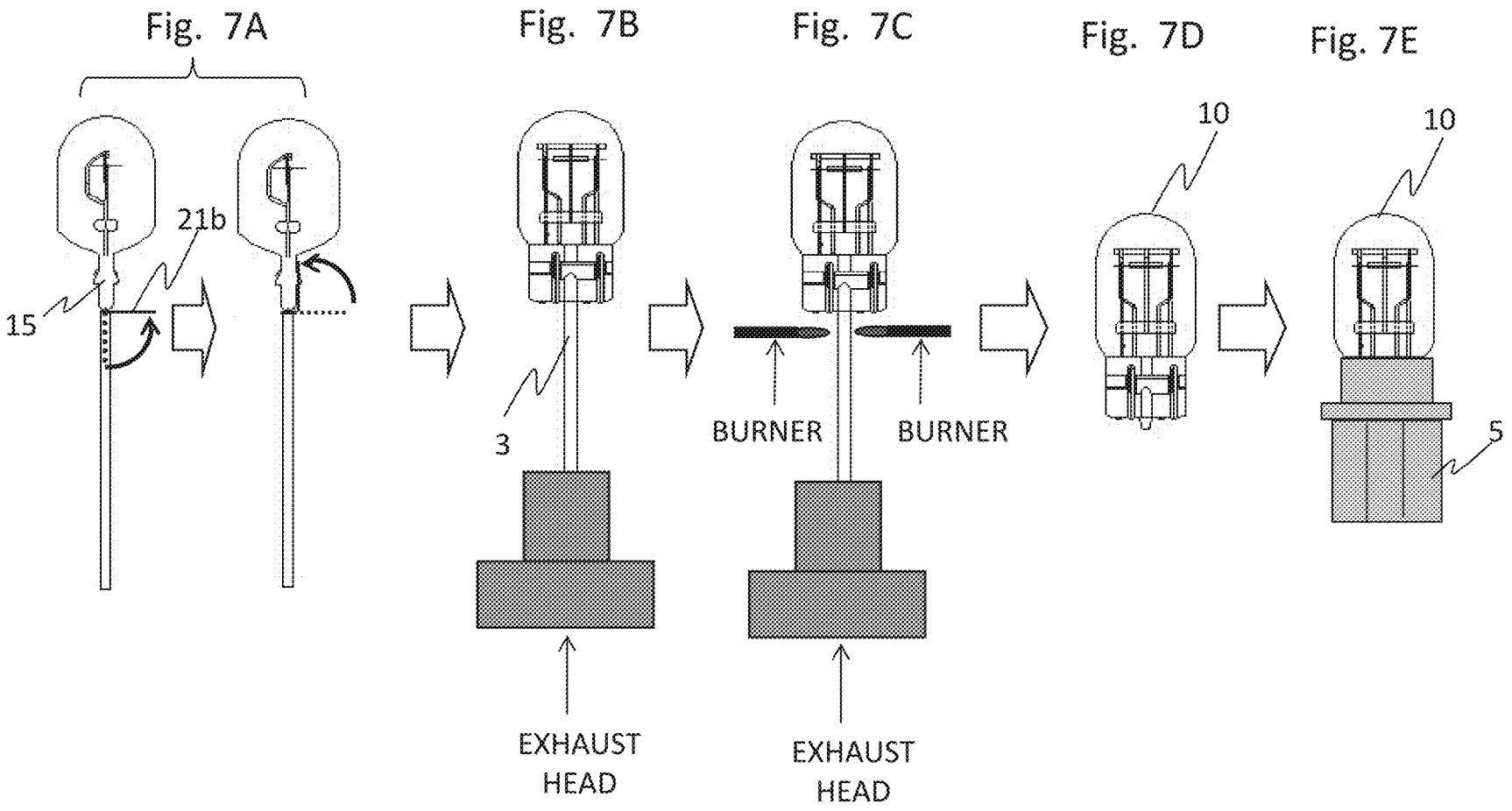
FIGS. 7A to 7E are diagrams illustrating the incandescent light bulb manufacturing method following FIGS. 6A to 6C.

The outer lead wires 21*b* outside the bulb, in this state, extend in the direction of extension of the lead wires in the bulb, and are bent and formed by a predetermined tool into a shape wherein the end portions are bent back to the outer periphery of the sealing portion 15 (FIG. 7A) . At this time, as shown in FIG. 3, an external force acts on the edge portion 15*a* of the sealing portion 15 due to bending stress applied to the lead wire 21, but the lead wire in this portion is crushed in advance and so are easy to bend against the external bending force, reducing the stress on the sealing portion's edge portion 15*a*. Also, the end portion of the crushed region in the sealing portion is in the sealing portion, and so can be prevent from being deformed at the boundary with the uncrushed portion continuous therewith.

Also, when bending back the outer lead wire 21*b* to the outer peripheral side of the sealing portion 15, too, the bending force applied to the lead wire acts on the edge portion 15*b* ranging from the end portion to the outer periphery of the sealing portion 15, but the lead wire in this portion is crushed in advance, thus reducing the stress on the edge portion 15*b*.

After that, as shown in FIG. 7B, the exhaust tube 3 is set on an exhaust head, and the inside of the bulb is exhausted and then sealed with an inert gas or the like. Subsequently, the exhaust tube 3 in the vicinity of the sealing portion 15 is heated, fused, and sealed by burners or the like (FIG. 7C), completing the incandescent light bulb 10 of the embodiment (FIG. 7D).

The wedge base type incandescent light bulb of the embodiment is plugged in a wedge base socket 5 and thus put to a predetermined use as a lamp or the like (FIG. 7E).

According to the embodiment, a predetermined region including partial portions of the outer lead wires, especially portions thereof to be bent when manufacturing, is crushed in advance, thereby reducing the external force (the stress on the sealing portion) applied to the sealing portion of the bulb when bending, and preventing a break of the sealing portion, an adhesion failure between the outer lead wires bent outwardly of the sealing portion and the socket terminal, and the like, and it is thus possible to provide an incandescent light bulb with a stable performance.

The embodiment illustrates the wedge base type incandescent light bulb having two filaments, but the invention, not being limited to this, can also be similarly applied to a wedge base type incandescent light bulb having one filament such as shown in FIGS. 1A to 1E.

What is claimed is:

1. An incandescent light bulb, comprising:

a filament assembly including filaments and a plurality of lead wires connected to the filaments; and a bulb which, having at an end portion thereof a sealing portion in which are fixed the plurality of lead wires, seals therein the filaments of and partial portions of the plurality of lead wires of the filament assembly, wherein each of the plurality of lead wires comprises an inner lead wire which is inside the bulb and an outer lead wire which is outside the bulb and has a circular cross section, the sealing portion has a first edge portion at a border between a lead wire portion inside the sealing portion and a lead wire portion outside of the sealing portion, and a second edge portion ranging from an end portion to an outer periphery of the sealing portion, the outer lead wire has a bending part which bends along a neighborhood of the first edge portion of the sealing portion and second edge portion, and an end part which extends along the outer periphery of the sealing portion, and the lead wires have a shape-changed region, consisting of an inner shape-changed region extending from the first edge portion of the sealing portion to inside the sealing portion and an outer shape-change region extending from the first edge portion of the sealing portion via the second edge portion to a part of the end part, in which the lead wires are changed in shape to be elliptical in cross section and a minor radius thereof is 90% or more of the radius of other portions of the lead wires.

2. The incandescent light bulb according to claim 1, wherein the shape-changed region of the lead wires is formed by crushing.

3. The incandescent light bulb according to claim 2, wherein the minor radius of the elliptical shape is from 95% to 98% of the radius of the other portions.

4. The incandescent light bulb according to claim 2, wherein the end portions of the lead wires opposite the end portions thereof connected to the filaments are bent back, forming doubled wire portions, and the shape-changed region is formed in the doubled wire portions.

5. The incandescent light bulb according to claim 2, wherein the length of the shape-changed region of the lead wires fixed in the sealing portion is shorter than the length of the sealing portion extending along the wire length of the lead wires.

6. The incandescent light bulb according to claim 1, wherein the minor radius of the elliptical shape is from 95% to 98% of the radius of the other portions.

7. The incandescent light bulb according to claim 6, wherein the end portions of the lead wires opposite the end portions thereof connected to the filaments are bent back, forming doubled wire portions, and the shape-changed region is formed in the doubled wire portions.

8. The incandescent light bulb according to claim 6, wherein the length of the shape-changed region of the lead wires fixed in the sealing portion is shorter than the length of the sealing portion extending along the wire length of the lead wires.

9. The incandescent light bulb according to claim 1, wherein the end portions of the lead wires opposite the end portions thereof connected to the filaments are bent back, forming doubled wire portions, and the shape-changed region is formed in the doubled wire portions.

10. The incandescent light bulb according to claim 9, wherein the length of the shape-changed region of the lead wires fixed in the sealing portion is shorter than the length of the sealing portion extending along the wire length of the lead wires.

11. The incandescent light bulb according to claim 1, wherein the length of the shape-changed region of the lead wires fixed in the sealing portion is shorter than the length of the sealing portion extending along the wire length of the lead wires.

* * * * *